US009162109B2

(12) United States Patent
Tang

(10) Patent No.: US 9,162,109 B2
(45) Date of Patent: Oct. 20, 2015

(54) FITNESS BOARD

(71) Applicant: Cheok Io Tang, Hongkong (CN)

(72) Inventor: Cheok Io Tang, Hongkong (CN)

( * ) Notice: Subject to any disclaimer, the term of this patent is extended or adjusted under 35 U.S.C. 154(b) by 168 days.

(21) Appl. No.: 14/094,729

(22) Filed: Dec. 2, 2013

(65) Prior Publication Data

US 2014/0256524 A1 Sep. 11, 2014

(30) Foreign Application Priority Data

Mar. 8, 2013 (CN) ..... 2013 1 0074924

(51) Int. Cl.

| | |
|---|---|
| ***A63B 21/00*** | (2006.01) |
| ***A63B 26/00*** | (2006.01) |
| ***A63B 21/06*** | (2006.01) |
| ***A63B 22/16*** | (2006.01) |
| ***A63B 22/20*** | (2006.01) |
| ***A63B 23/04*** | (2006.01) |
| ***A63B 23/12*** | (2006.01) |

(52) U.S. Cl.

CPC ..... *A63B 26/003* (2013.01); *A63B 21/0602* (2013.01); *A63B 21/1469* (2013.01); *A63B 22/16* (2013.01); *A63B 22/20* (2013.01); *A63B 23/0458* (2013.01); *A63B 23/1236* (2013.01)

(58) Field of Classification Search

CPC ..... A63B 21/00

USPC ..... 482/126, 93, 82, 108, 74

See application file for complete search history.

(56) References Cited

U.S. PATENT DOCUMENTS

| | | | | |
|---|---|---|---|---|
| 4,995,604 | A * | 2/1991 | Lynch et al. | 482/55 |
| 5,056,778 | A * | 10/1991 | Hull et al. | 482/105 |
| 5,716,305 | A * | 2/1998 | Selsam | 482/93 |
| 7,972,250 | B2 | 7/2011 | Viselman | |
| 8,727,951 | B2 * | 5/2014 | Jones et al. | 482/93 |
| 2008/0242515 | A1 | 10/2008 | Odien | |
| 2011/0269603 | A1 | 11/2011 | Lin | |
| 2014/0024504 | A1 * | 1/2014 | Potts et al. | 482/106 |

FOREIGN PATENT DOCUMENTS

| | | | |
|---|---|---|---|
| CN | 2540990 | Y | 3/2003 |
| CN | 202699940 | U | 1/2013 |
| FR | 2875139 | A1 | 3/2006 |
| WO | 03/101544 | A1 | 12/2003 |

* cited by examiner

*Primary Examiner* — Jerome W Donnelly

(57) ABSTRACT

A fitness board, including: a fitness board body, the fitness board body including a center and a margin; a first cavity; a second cavity; and a flow regulating mechanism. The first cavity is disposed inside the center of the fitness board body. The second cavity is disposed inside the fitness board body and winds around the margin thereof. The first cavity communicates with the second cavity. The first cavity and the second cavity are filled with a liquid. The volume of the liquid is smaller than the total capacity of the first cavity and the second cavity. The flow regulating mechanism is disposed inside the first cavity and/or the second cavity.

11 Claims, 6 Drawing Sheets

FITNESS BOARD

CROSS-REFERENCE TO RELATED APPLICATIONS

Pursuant to 35 U.S.C. §119 and the Paris Convention Treaty, this application claims the benefit of Chinese Patent Application No. 201310074924.1 filed Mar. 8, 2013, the contents of which are incorporated herein by reference. Inquiries from the public to applicants or assignees concerning this document or the related applications should be directed to: Matthias Scholl P.C., Attn.: Dr. Matthias Scholl Esq., 14781 Memorial Drive, Suite 1319, Houston, Tex. 77079.

BACKGROUND OF THE INVENTION

1. Field of the Invention

The invention relates to fitness equipment, and more particularly to a multi-functional fitness board.

2. Description of the Related Art

Existing fitness equipment includes rowing machines, bodybuilding vehicles, walking machines, treadmills, waist beautifying machine, hand-muscle developers, and abdominal boards, all of which only have a single-function.

The existing fitness equipment easily bore people due to their monotonous motion pattern and insufficiency in challenge. Therefore, people are eager for a type of multi-functional fitness equipment that is able to provide multiple training methods and regulate training intensity based on the user's conditions and thus to bring different experiences to his or her body. The multi-functional equipment also effectively reduces the quantity and space of storing many types of single-functional equipment for different training needs, which is convenient for users to exercise at home or in gyms.

SUMMARY OF THE INVENTION

In view of the above-described problems, it is one objective of the invention to provide a fitness board that has multi-functions and overcomes the defect of monotonous motion pattern of the existing fitness equipment.

To achieve the above objective, in accordance with one embodiment of the invention, there is provided a fitness board comprising: a fitness board body; a first cavity; a second cavity; and a flow regulating mechanism. The first cavity and the second cavity are disposed inside the fitness board body. The first cavity communicates with the second cavity. The first cavity and the second cavity are filled with a first liquid. A volume of the first liquid is smaller than a total capacity of the first cavity and the second cavity. The flow regulating mechanism is disposed inside the first cavity and/or the second cavity.

In a class of this embodiment, the fitness board body comprises a center and a margin; the first cavity is disposed inside the center of the fitness board body; and the second cavity is disposed inside the fitness board body and winds around the margin thereof.

In a class of this embodiment, the flow regulating mechanism comprises: recesses and/or projections arranged on an inner wall of the first cavity, or a closed pipe winding around the second cavity and the recesses and/or projections arranged on the inner wall of the first cavity. The enclosed tube winds around the second cavity. The closed tube is filled with a second liquid, and a volume of the second liquid is smaller than a capacity of the closed tube.

In a class of this embodiment, the first cavity and/or the second cavity are provided with openings, and each opening is provided with a removable seal cover.

In a class of this embodiment, the fitness board body is provided with a first hole for holding convenience of a body-builder.

In a class of this embodiment, the fitness board body is a flat plate or a curved plate.

In a class of this embodiment, the fitness board body is provided with a wheel.

In a class of this embodiment, a second hole is arranged on the center of the fitness board body for fixing the wheel.

In a class of this embodiment, the fitness board body is an integrated structure, or is formed by pressing a top plate and a bottom plate into a whole body.

In a class of this embodiment, the fitness board has a length of between 40 cm and 70 cm, a width of between 20 cm and 40 cm, and a thickness of between 3 cm and 12 cm.

Advantages of the invention are as follows: the fitness board of the invention integrates multi-functions of different kinds of fitness equipment. The reason is that the flow direction of the liquid inside changes with different exercises taken by the body-builder, and the center of gravity will also change accordingly, which produces different training experiences and effects.

BRIEF DESCRIPTION OF THE DRAWINGS

The invention is described hereinbelow with reference to the accompanying drawings, in which.

DETAILED DESCRIPTION OF THE EMBODIMENTS

For further illustrating the invention, experiments detailing a fitness board are described below. It should be noted that the following examples are intended to describe and not to limit the invention.

Example 1

Figure 1A:
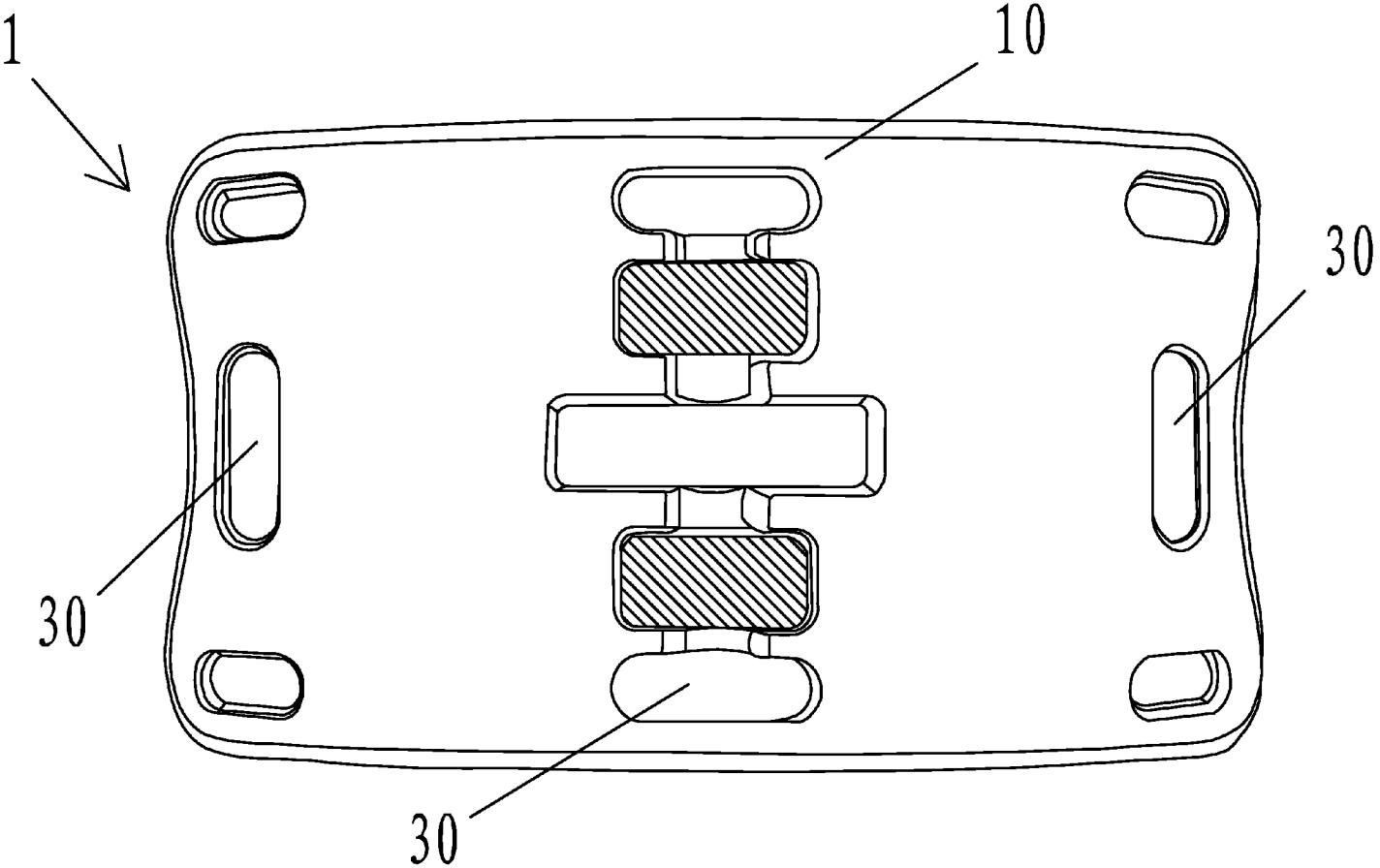
FIG. 1A is a structure diagram of a fitness board in accordance with Example 1.
Figure 1B:
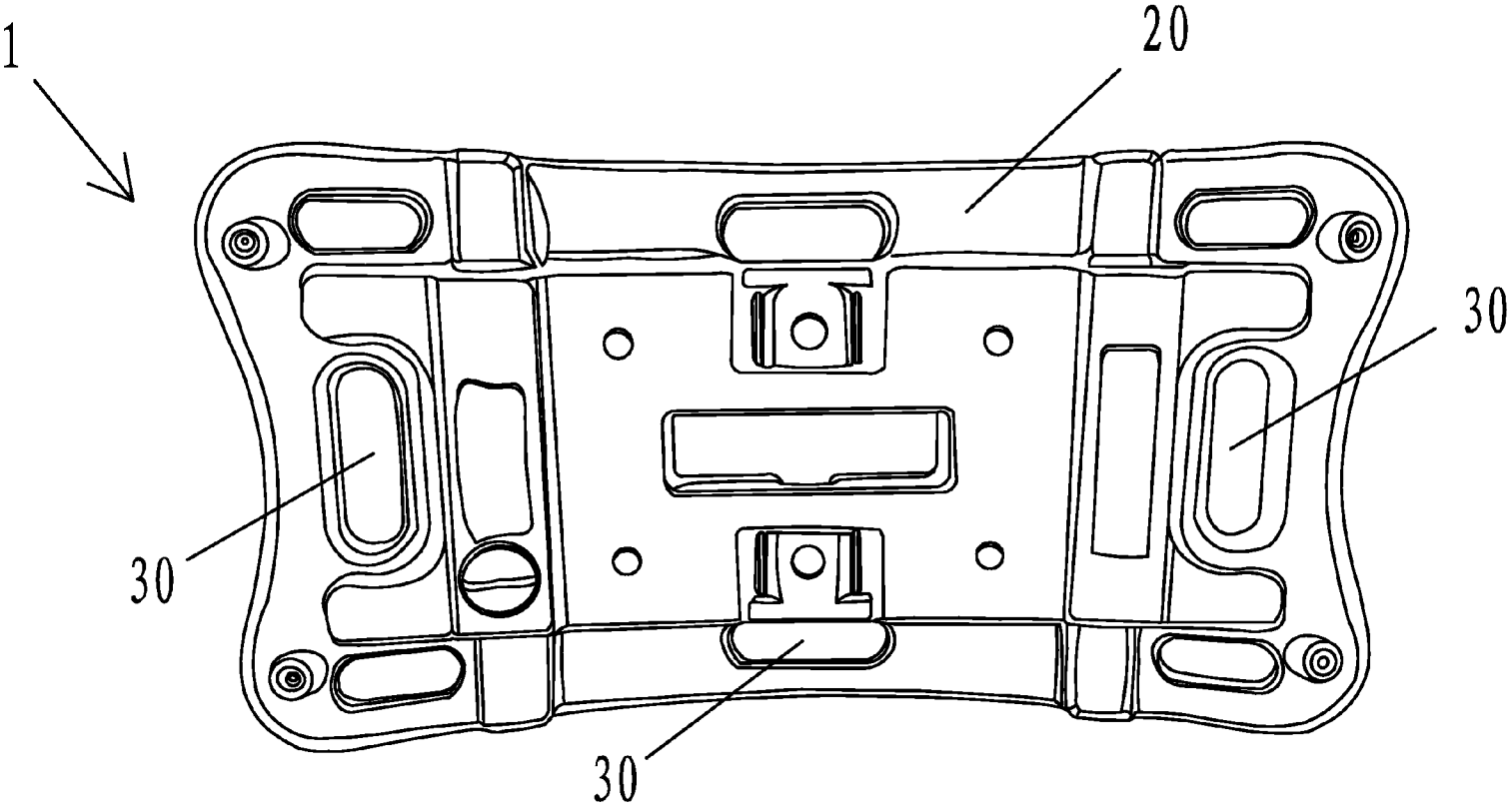
FIG. 1B is a structure diagram of a bottom plate of a fitness board in accordance with Example 1.
Figure 1C:
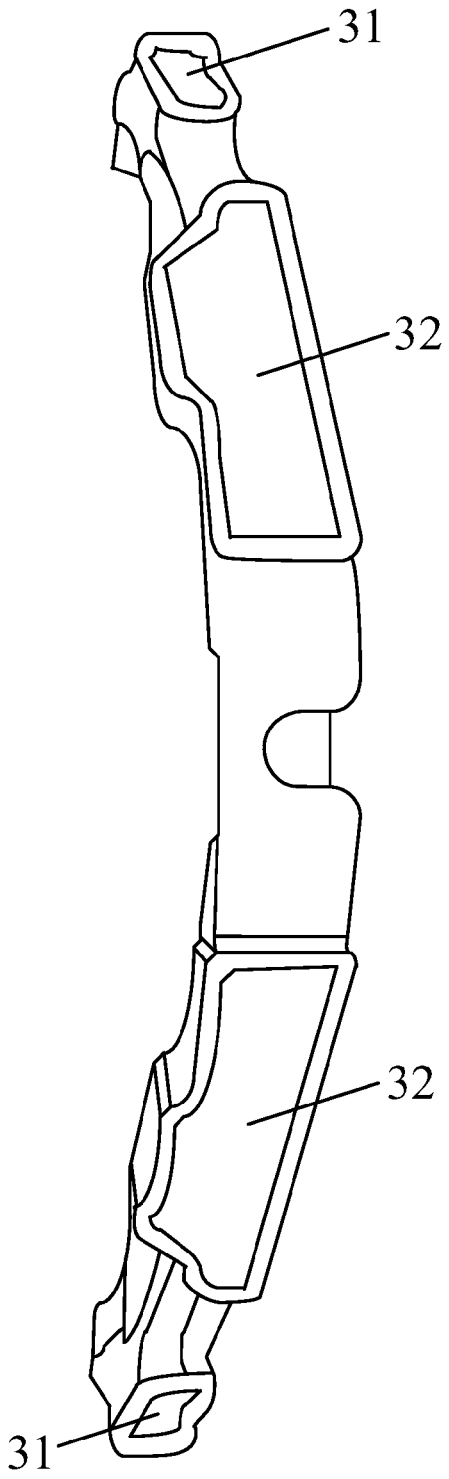
FIG. 1C is a cross sectional view of a fitness board in accordance with Example 1.

As shown in FIGS. 1A-1C, a fitness board comprises: a fitness board body 1, the fitness board body comprising a center and a margin; a first cavity 32; a second cavity 31, the second cavity comprising an inner wall; and a flow regulating mechanism. The first cavity 32 is disposed inside the center of the fitness board body 1. The second cavity 31 is disposed inside the fitness board body 1 and winds around the margin thereof. The inner wall of the second cavity 31 is smooth; the first cavity 32 communicates with the second cavity 31. The first cavity 32 and the second cavity 31 are filled with a first liquid. A volume of the first liquid is smaller than a total capacity of the first cavity 32 and the second cavity 31. The flow regulating mechanism is disposed inside the first cavity and/or the second cavity.

When the fitness board is in use, the weight of the first liquid in the cavity at the low level is prohibited from increasing quickly by regulating the velocity of the liquid flow by the flow regulating mechanism. Instead, the weight of the first liquid increase slowly under the regulation of the flow regulating mechanism, so that the center of gravity of the fitness board will change slowly. If a body-builder holds the different parts of the fitness board, its center of gravity will change accordingly, which increases the intensity of the training.

Besides the above mentioned structural form, other forms that can achieve the same function can also be applied to the design of the cavities.

The flow regulating mechanism regulates the velocity of the liquid flow. Preferably, the flow regulating mechanism comprises: recesses and/or projections arranged on an inner wall of the first cavity; or a closed pipe winding around the second cavity and the recesses and/or projections arranged on the inner wall of the first cavity. The enclosed tube winds around the second cavity. The closed tube is filled with a second liquid, and a volume of the second liquid is smaller than a capacity of the closed tube.

The operation principle of the fitness board is as follows: when a body-builder sways the fitness board, the smoothness of the inner wall of the second cavity will make the liquid in the second cavity flow instantly and produce impulsive force; while because of the regulation of the water flow mechanism, the liquid of the first cavity flows slowly and produces the impulsive force later. In this way, the body-builder will feel the impulsive force to the same direction for several times in swaying the fitness board. For instance, if he sways the fitness board to the left, he will feel the impulsive force to the left 2-3 times, thereby intensifying the training effects.

Taking advantage of the uncertainty of the liquid fluidity, the fitness board of the invention brings different experiences every time the user takes the training, producing better training effects. Moreover, the liquids often employ liquid water to fill in the cavities, because the liquid water is common, and features low cost and good fluidity.

The fitness board is made of hard plastics. It is an integrated structure, or is formed by pressing a top plate and a bottom plate (such as the top plate 10 and the bottom plate 20 in FIGS. 1A and 1B, and the top plate 11 and the bottom plate 21 in FIGS. 2A and 2B) into a whole body. Preferably, the fitness board has a length of between 40 cm and 70 cm, a width of between 20 cm and 40 cm, and a thickness of between 3 cm and 12 cm.

Preferably, the first cavity and/or the second cavity are provided with openings, and each opening is provided with a removable seal cover. The user can pour in or out the liquid from the opening to regulate the amount of the liquid in the cavities.

The fitness board body is provided with a first hole 30 for the holding convenience of the body-builder. The first hole 30 is located at a corner of the fitness board body 1. The number of the first hole is unlimited, e.g., such the first hole can be arranged at each of the four corners of the fitness board body 1.

Besides, preferably, the fitness board body 1 is a flat plate or a curved plate. When the curved plate is adopted, the bending angle of the plate is between 5° and 30°. The body-builder is capable of using the fitness board as a seesaw by placing the curve plate on the floor and standing on the plate. When the flat plate is adopted, the body-builder is capable of using the fitness board body 1 as a dumbbell by holding it through the first holes for holding convenience.

The shape of the fitness board body is square (square flat plate or square curve plate), rectangle (rectangle flat plate or rectangle curve plate), triangular (triangular flat plate or triangular curve plate), or round (round flat plat or round curve plate). Its shape can be designed according to the needs freely.

Example 2

Figure 2A:
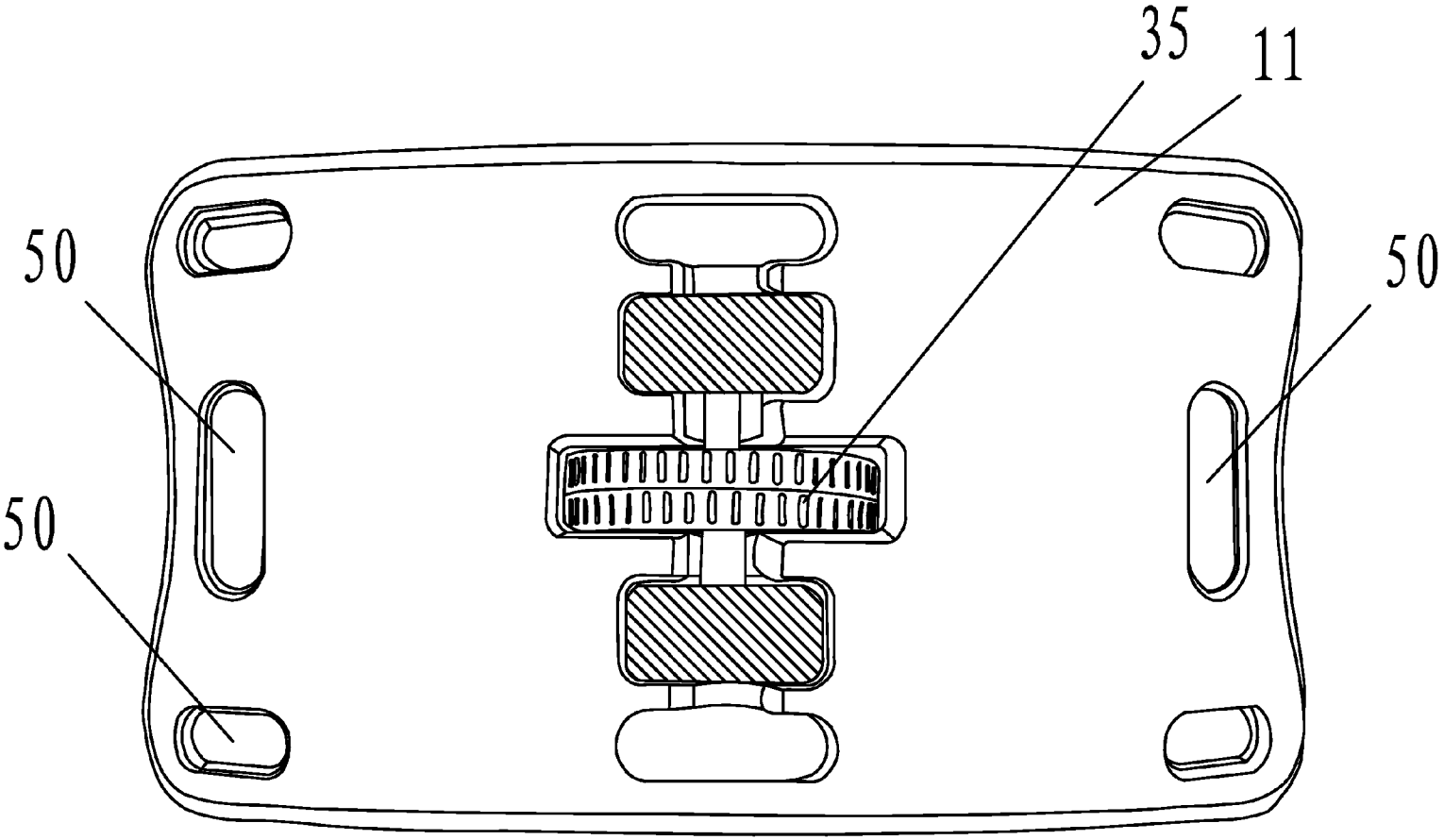
FIG. 2A is a structure diagram of a top plate of a fitness board in accordance with Example 2.
Figure 2B:
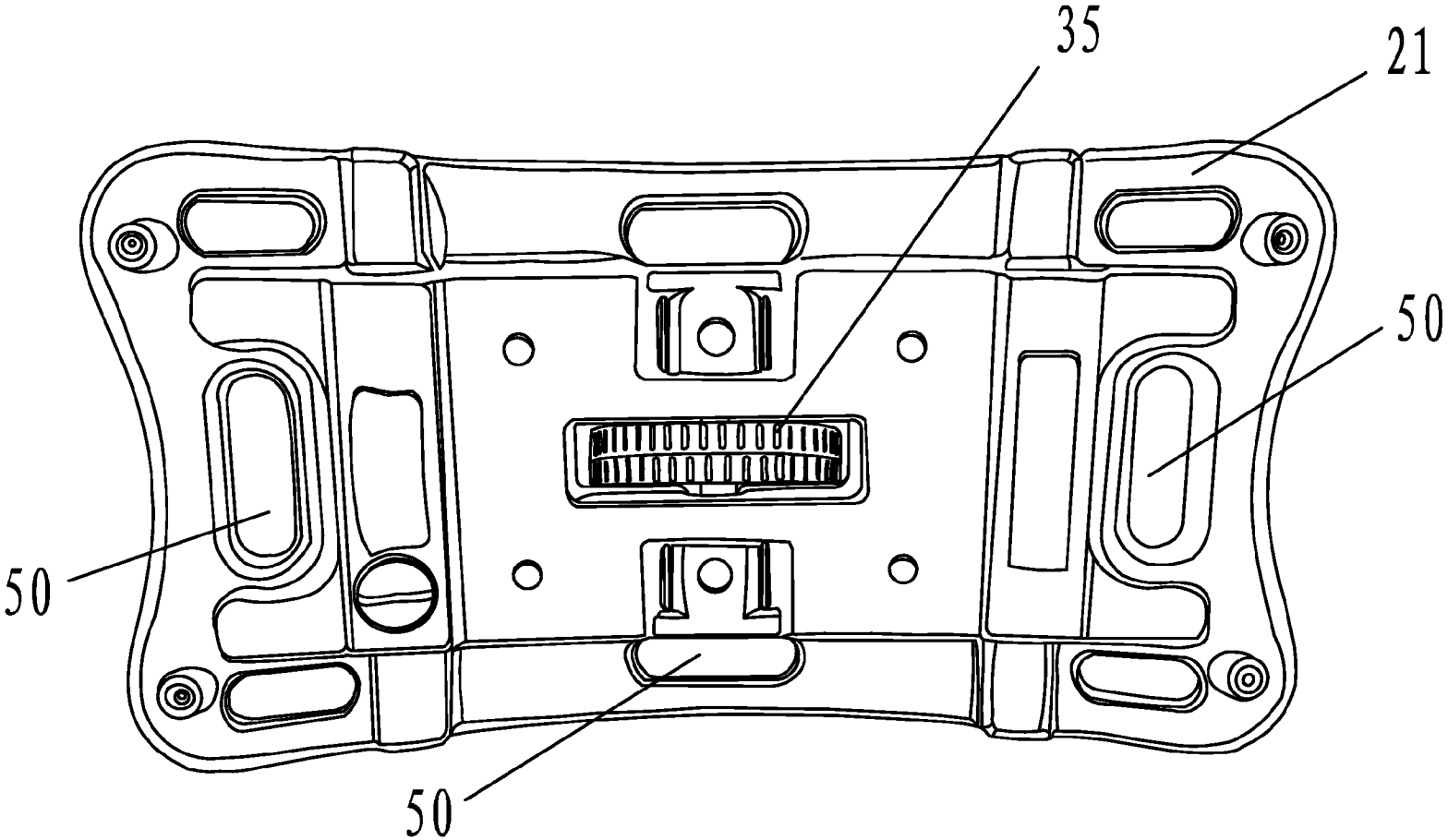
FIG. 2B is a structure diagram of a bottom plate of a fitness board in accordance with Example 2.
Figure 2C:
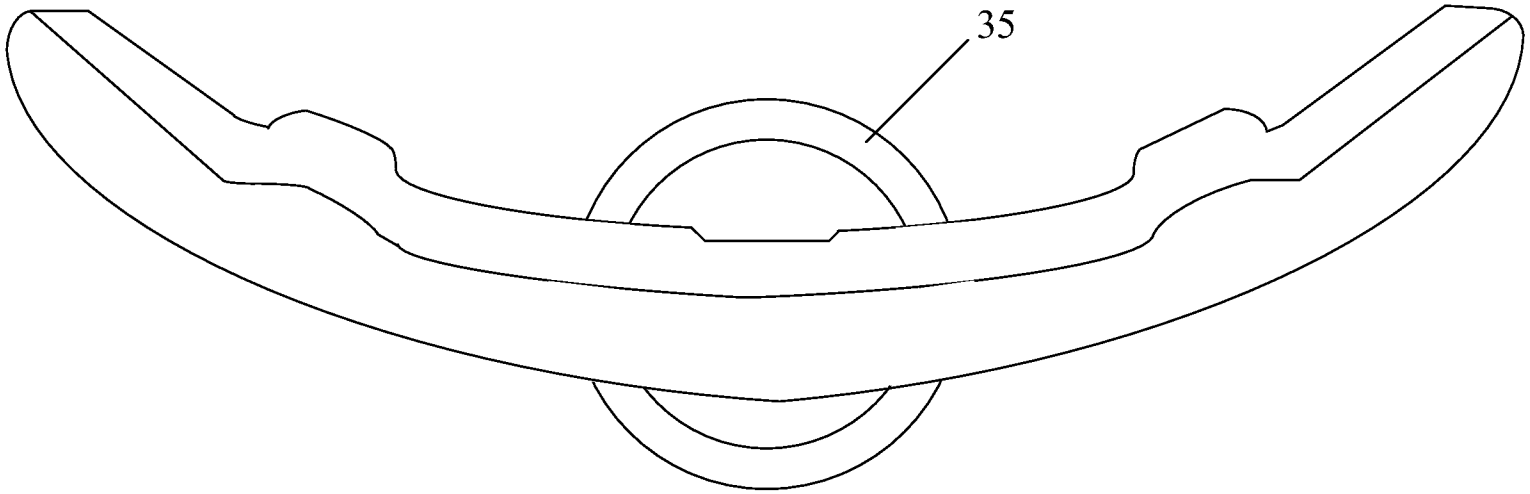
FIG. 2C is a side view of a fitness board in accordance with Example 2.

As shown in FIGS. 2A-2C (taking the case of a curve plate as a fitness board body as an example), a fitness board is provided in the example of the invention. The structure of the fitness board herein is the same as that in Example 1 except that the fitness board body 1 is equipped with a wheel 35.

If the wheel 35 is provided in the fitness board body 1, the body-builder is able to use the fitness board 1 as a balancing plate by placing the fitness board body 1 on the floor and standing on the fitness board 1. The body-builder is also able to do the rotary motion on the floor with the wheel 35 by standing on the floor and holding the fitness board body 1.

The arrangement of the wheel is as follows: a second hole 50 is arranged on the center of the fitness board body 1 for fixing the wheel 35. The body-builder is able to do the rotary motion on the floor with the wheel by holding the fitness board body 1. Or several wheels are provided at proper positions of the fitness board body according to the needs, e.g., at each end of the fitness board body the second hole is bored for fixing the wheel through each second hole.

Compared with fitness equipment in the prior art, the fitness board of the invention integrates multi-functions of different kinds of fitness equipment. The reason is that the flow direction of the liquid inside changes with different exercises taken by the body-builder, and the center of gravity will also change accordingly, which produces different training experiences and effects.

The fitness board provided in the technical scheme avoids the use of electricity. The inside liquid fluidity, impulsive force and the outside holding holes bring more functions and better experiences to the body-builder.

Unless otherwise indicated, the numerical ranges involved in the invention include the end values.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A fitness board, comprising:

a) a fitness board body;

b) a first cavity;

c) a second cavity; and d) a flow regulating mechanism;

wherein the first cavity and the second cavity are disposed inside the fitness board body;

the first cavity communicates with the second cavity;

the first cavity and the second cavity are filled with a first liquid;

a volume of the first liquid is smaller than a total capacity of the first cavity and the second cavity; and the flow regulating mechanism is disposed inside the first cavity and/or the second cavity.

2. The fitness board of claim 1, wherein the fitness board body comprises a center and a margin; the first cavity is disposed inside the center of the fitness board body; and the second cavity is disposed inside the fitness board body and winds around the margin thereof.

3. The fitness board of claim 1, wherein the flow regulating mechanism comprises: recesses and/or projections arranged on an inner wall of the first cavity, or a closed pipe winding around the second cavity and the recesses and/or projections arranged on the inner wall of the first cavity; the closed pipe is filled with a second liquid, and a volume of the second liquid is smaller than a capacity of the closed tube.

4. The fitness board of claim 1, wherein the first cavity and/or the second cavity are provided with openings, and each opening is provided with a removable seal cover.

5. The fitness board of claim 1, wherein the fitness board body is provided with a first hole for holding convenience of a body-builder.

6. The fitness board of claim 1, wherein the fitness board body is a flat plate or a curved plate.

7. The fitness board of claim 1, wherein the fitness board body is provided with a wheel.

8. The fitness board of claim 6, wherein the fitness board body is provided with a wheel.

9. The fitness board of claim 8, wherein a second hole is arranged on the center of the fitness board body for fixing the wheel.

10. The fitness board of claim 1, wherein the fitness board body is an integrated structure, or is formed by pressing a top plate and a bottom plate into a whole body.

11. The fitness board of claim 1, wherein the fitness board has a length of between 40 cm and 70 cm, a width of between 20 cm and 40 cm, and a thickness of between 3 cm and 12 cm.

* * * * *